US011028800B1

(12) United States Patent
Kumar et al.

(10) Patent No.: US 11,028,800 B1
(45) Date of Patent: Jun. 8, 2021

(54) ENGINE COOLANT SYSTEM AND METHOD

(71) Applicant: Transportation IP Holdings, LLC, Norwalk, CT (US)

(72) Inventors: Kotha Ramesh Kumar, Bangalore (IN); Ganesha Koggu Naik, Bangalore (IN)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 0 days.

(21) Appl. No.: 16/688,939

(22) Filed: Nov. 19, 2019

(51) Int. Cl.

| | |
|---|---|
| ***F02F 1/16*** | (2006.01) |
| ***F02F 1/14*** | (2006.01) |
| ***F01P 3/02*** | (2006.01) |
| ***F01P 3/12*** | (2006.01) |
| ***F01P 7/14*** | (2006.01) |
| ***F01P 5/10*** | (2006.01) |

(52) U.S. Cl.
CPC *F02F 1/16* (2013.01); *F01P 3/02* (2013.01); *F01P 3/12* (2013.01); *F01P 5/10* (2013.01); *F01P 7/14* (2013.01); *F02F 1/14* (2013.01); *F01P 2003/027* (2013.01); *F01P 2007/146* (2013.01); *F01P 2025/33* (2013.01)

(58) Field of Classification Search
CPC ..... F02F 1/16; F02F 1/14; F01P 3/12; F01P 5/10; F01P 7/14; F01P 3/02; F01P 2003/027; F01P 2025/33; F01P 2007/146
See application file for complete search history.

(56) References Cited

U.S. PATENT DOCUMENTS

| | | | | |
|---|---|---|---|---|
| 2005/0065706 | A1* | 3/2005 | Gray, Jr. | F02D 41/3035 701/103 |
| 2014/0123919 | A1* | 5/2014 | Shibata | F01N 3/32 123/41.56 |
| 2015/0034028 | A1* | 2/2015 | Zahdeh | F01P 3/02 123/41.28 |
| 2017/0268455 | A1* | 9/2017 | Yang | F02F 1/4264 |
| 2018/0230934 | A1* | 8/2018 | Hopf | F01P 5/10 |

OTHER PUBLICATIONS

Kumar, K., "GASKET," U.S. Appl. No. 29/713,902, filed Nov. 19, 2019, 7 pages.
Kumar, K., "Sealing Apparatus with Retention Ribs," U.S. Appl. No. 29/713,904, filed Nov. 19, 2019, 10 pages.
Kumar, K., "Engine Cylinder Liner with Linear Catcher," U.S. Appl. No. 16/688,863, filed Nov. 19, 2019, 22 pages.

* cited by examiner

*Primary Examiner* — Jacob M Amick
*Assistant Examiner* — Charles Brauch
(74) *Attorney, Agent, or Firm* — McCoy Russell LLP

(57) ABSTRACT

Methods and systems are provided for a coolant system coupled to cylinders in a locomotive engine. In one example, a coolant system coupled to an individual cylinder may include a cylinder liner jacket encircling the cylinder, a cylinder head lower coolant jacket surrounding a lower surface of a cylinder head placed over the cylinder, a cylinder head upper coolant jacket surrounding an upper surface of the cylinder head, and a cylinder head exhaust port cooling jacket surrounding an exhaust port of the cylinder. Coolant may flow to each of the cooling jackets from a coolant feed gallery located in the engine crankcase, and after flowing through the engine, the coolant may return to a coolant return gallery also located in the engine crankcase.

19 Claims, 8 Drawing Sheets

ENGINE COOLANT SYSTEM AND METHOD

FIELD

Embodiments relate to engines. Other embodiments relate to coolant systems for engines.

BACKGROUND

During engine operation, cylinder combustion generates a large amount of heat. To reduce thermal damage to engine components and improve engine performance efficiency, engine components are cooled via a coolant system. Therein, liquid coolant is pumped and circulated around heat-generating engine components via cooling jackets connected to the coolant system via specialized coolant flow passages. Heated coolant is cooled upon passage through a radiator, where heat is lost to ambient air. Additionally, heated coolant may be circulated through engine components requiring heat, such as a heater core. A thermostat may be included to control coolant flow based on temperature.

Due to the relative position of engine components, however, adequate cooling may not be achieved. For example, components closer to the coolant system pump and the thermostat may receive a greater amount of coolant flow as compared to other components further away. As another example, the increased coolant flow may facilitate in improving heat rejection to coolant and cooling required for engine components to achieve improved performance, efficiency, and reliability. In addition, due to the configuration of the coolant system as well as the packaging constraints of the vehicle under-hood area, coolant may flow uni-directionally through components in a specified order. This makes it difficult to direct more coolant flow to some components while reducing coolant flow to other components.

BRIEF DESCRIPTION OF THE INVENTION

Methods and systems are provided for improving the efficiency of cylinder head cooling and for enabling regulated coolant flow control. In one embodiment, an engine coolant system comprises a plurality of cooling passages coupled to corresponding cylinder heads of an engine block.

In one embodiment, a coolant system for a locomotive engine or other vehicle engine or other engine may have a plurality of coolant subunits, each subunit coupled to one cylinder of the engine. Each subunit may include a central cylinder liner jacket that surrounds the cylinder liner of the corresponding cylinder like a sleeve. A central axis of the liner jacket is coaxial with a central axis of the corresponding cylinder. A cylinder head feed line directs coolant from a first opening coupled to an outer surface of the liner jacket to a cylinder head lower coolant jacket. A cylinder liner feedline receives coolant at a second opening coupled to the outer surface of the liner jacket from a first port of a crankcase coolant feed gallery. The crankcase feed gallery is positioned coplanar to a lower surface of the liner jacket, and abuts the liner jacket on one side of the central axis. Coolant is concurrently directed from the crankcase coolant feed gallery to the cylinder head lower coolant jacket which is configured as a ring positioned above and concentric with the cylinder liner jacket. After flowing through the lower coolant jacket, a first portion of coolant is directed to an upper coolant jacket positioned above the lower coolant jacket via a first outlet while a second, remaining portion of coolant is directed to an exhaust port cooling jacket via a second outlet. The upper coolant jacket includes a central cylindrical piece that is concentric with the lower coolant jacket and cylinder liner jacket, the upper coolant jacket further including a projection extending from the central cylindrical piece towards the crankcase feed gallery on the one side of the central axis of the liner jacket. The exhaust port cooling jacket extends outwards from the central axis of the liner jacket and abuts a drilling coupling the upper coolant jacket to the lower coolant jacket. Coolant circulated through the exhaust cooling port is returned to the cylinder head upper coolant jacket. The combined coolant flow then returns via a return feed line extending from the projection on the upper coolant jacket to a crankcase coolant return gallery positioned below the crankcase coolant feed gallery in a crankcase. In this manner, coolant is concurrently circulated to a cylinder liner and a lower portion of a cylinder head of a cylinder to improve cooling efficiency. Coolant from the lower portion is then divided between an exhaust cooling port and an upper portion of the cylinder head to enable regulated cylinder head cooling. Finally, the coolant flow is merged before being returned to a return gallery in the crankcase which is common to all cylinders, thereby allowing for easier packaging of the cooling system components It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF FIGURES

The present invention will be better understood from reading the following description of non-limiting embodiments, with reference to the attached drawings, wherein below:

FIG. 1 shows a cross sectional view of an example engine block and coolant passages passing there-through.

DETAILED DESCRIPTION

Figure 1:
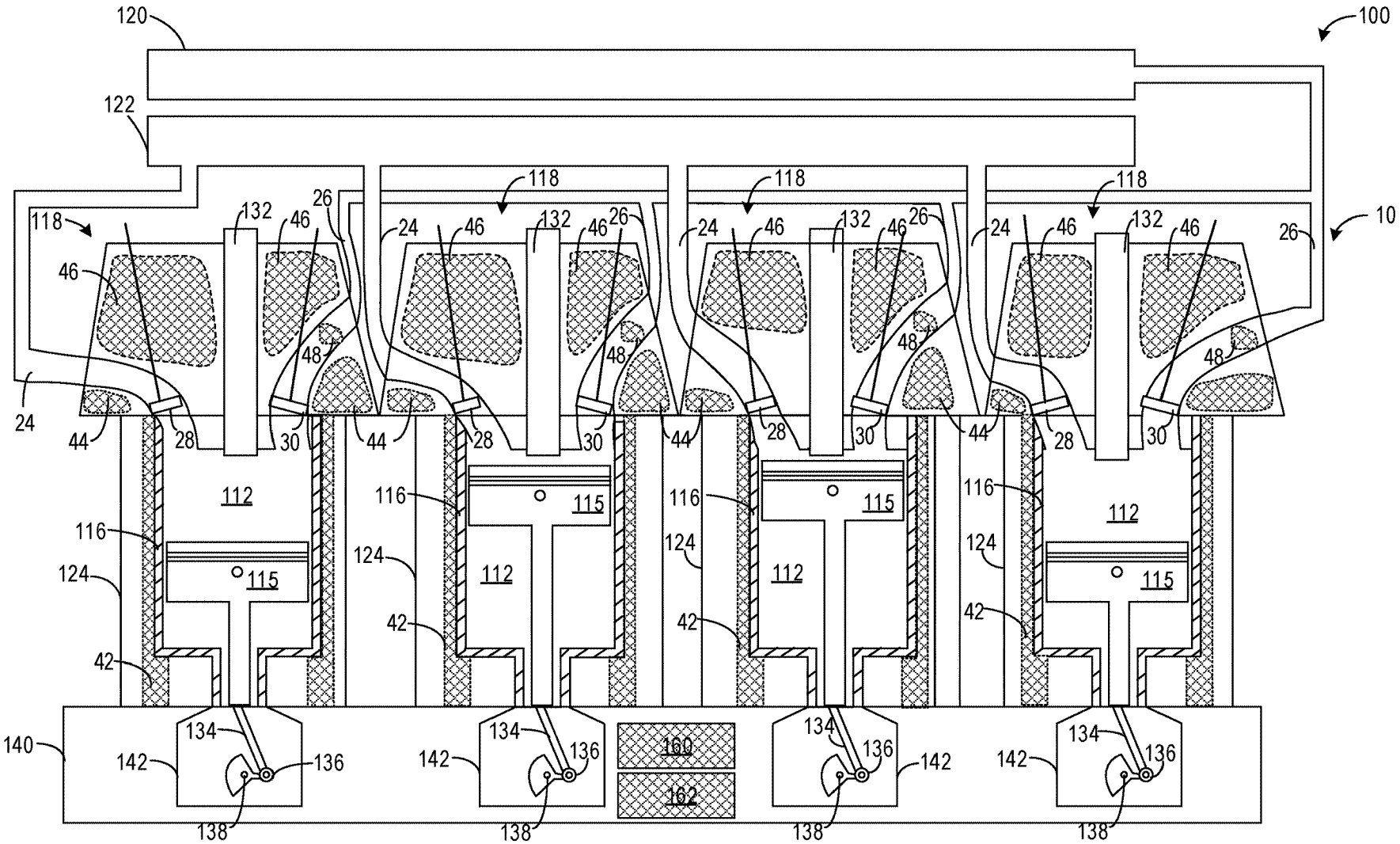

FIG. 1 shows a cross sectional view 100 of an example engine block 10 of an engine (e.g., a locomotive engine, or other vehicle engine, or other engine, such as for a stationary generator) and coolant passages passing through the components of the engine block 10. The engine block 10 may include a plurality of cylinder bores 124 (also referred herein as cylinder 124) suitably formed therein. A cylinder head 118 may be positioned atop each cylinder bore 124 and may abut upper surface of the walls around the cylinder bore 124. Gaskets (including a head gasket) and spacers may be used to position the cylinder head 118 above each cylinder bore 124. In this example, four cylinder bores 124 along with four corresponding cylinder heads 118 are shown. Each cylinder bore 124 along with the corresponding cylinder head 118 may enclose a combustion chamber 112.

Each combustion chamber 112 may be coupled to an intake port 24 and an exhaust port 26. During combustion, fuel and air mixture may be introduced from an intake manifold 122 to the combustion chamber 112 via the intake port 24. An intake valve 28 may open during the intake stroke to admit a desired amount of the air fuel mixture. The cylinder head 118 of each cylinder may include a injector which will provide diesel fuel in to the combustion chamber 112 to initiate combustion. After combustion, residual gas mixture (exhaust) may be routed from the combustion chamber to the exhaust manifold 120 via the exhaust port 26. During the exhaust stroke, an exhaust valve 30 may open facilitating removal of exhaust gas from the combustion chamber 112 to the exhaust manifold 120. Each cylinder 124 may include a separate intake port 24 and an exhaust port 26 while sharing a common intake manifold 122 and an exhaust manifold 120.

A cylinder liner 116 may be concentrically disposed in the cylinder bore 124 encasing the combustion chamber 112. By reinforcing the cylinder bore 124 with a cylinder liner, the inner wall of the cylinder bore 124 may be protected from wear caused by prolonged sliding contact with a moving piston. The liner typically includes a flange that enables the liner to rest on an engine block. The cylinder liner is then held over the cylinder bore using vertical support via the flange. In one example, the cylinder liner 116 may have a constant diameter around the cylinder bore 124. In another example (as seen here), diameter of the cylinder liner 116 may change between the cylinder head 118 and the crankcase 142. The cylinder liner 116 may have a first diameter closer to the cylinder head 118 and a second diameter closer to the crankcase 142, the first diameter larger than the second diameter.

A piston 115 may be positioned within the combustion chamber 112 with a wrist pin coupling the piston 115 to a connecting rod 134 which has its lower end attached to the engine's crankshaft via a crankpin 136. The crankshaft may be enclosed in a crankcase 142. Each cylinder bore 124 may have a corresponding crankcase 142 while each of the crankcases in the engine block 10 may be enclosed in a crankcase housing 140.

The coolant system may include each of a crankcase coolant feed gallery 160 positioned within the crankcase housing 140 and below each of the cylinder bores 124 and a crankcase coolant return galley 162 positioned within the crankcase housing 140 and directly below the crankcase coolant feed gallery 160.

The crankcase coolant feed gallery 160 may be fluidically coupled to a central cylinder liner jacket 42 enclosing a corresponding cylinder liner 116 for each cylinder 124. The crankcase coolant feed gallery 160 may enclose the central cylinder liner jacket 42 like a sleeve. In this example, there may be four central cylinder liner jackets 42 corresponding to the four cylinders 124. The cylinder bore 124, the cylinder liner 116, and the cylinder liner jacket 42 may be coaxial with a central axis. The cylinder liner jacket 42 may be fluidically coupled to a lower coolant jacket 44 surrounding a lower surface of the cylinder head 118 and placed directly above the cylinder bore 124. The crankcase coolant feed gallery 160 may also be directly coupled to the lower coolant jacket 44. The lower coolant jacket may be coupled to an upper coolant jacket 46 surrounding an upper surface of the cylinder head 118, the lower coolant jacket 44 coaxial with the upper coolant jacket 46. Further, a coolant line may couple the lower coolant jacket 44 to an exhaust port cooling jacket 48 surrounding the exhaust port 26. The exhaust port cooling jacket 48 may be coupled between the upper coolant jacket 46 and the lower coolant jacket 44, and offset to one side of the central axis. The exhaust port cooling jacket 48 may be fluidically coupled to the upper coolant jacket 46 which in turn may be fluidically coupled to crankcase coolant return galley 162. As discussed in details with relation to FIG. 2, coolant may flow from the crankcase coolant feed gallery 160 to the crankcase coolant return galley 162 via each of the central cylinder liner jacket 42, the lower feed gallery 44, the upper feed galley 46, and the exhaust feed gallery 48, thereby cooling each of engine cylinder liner 116, the cylinder head 118, and the exhaust port 26 for each cylinder in the cylinder block 10.

Figure 2:
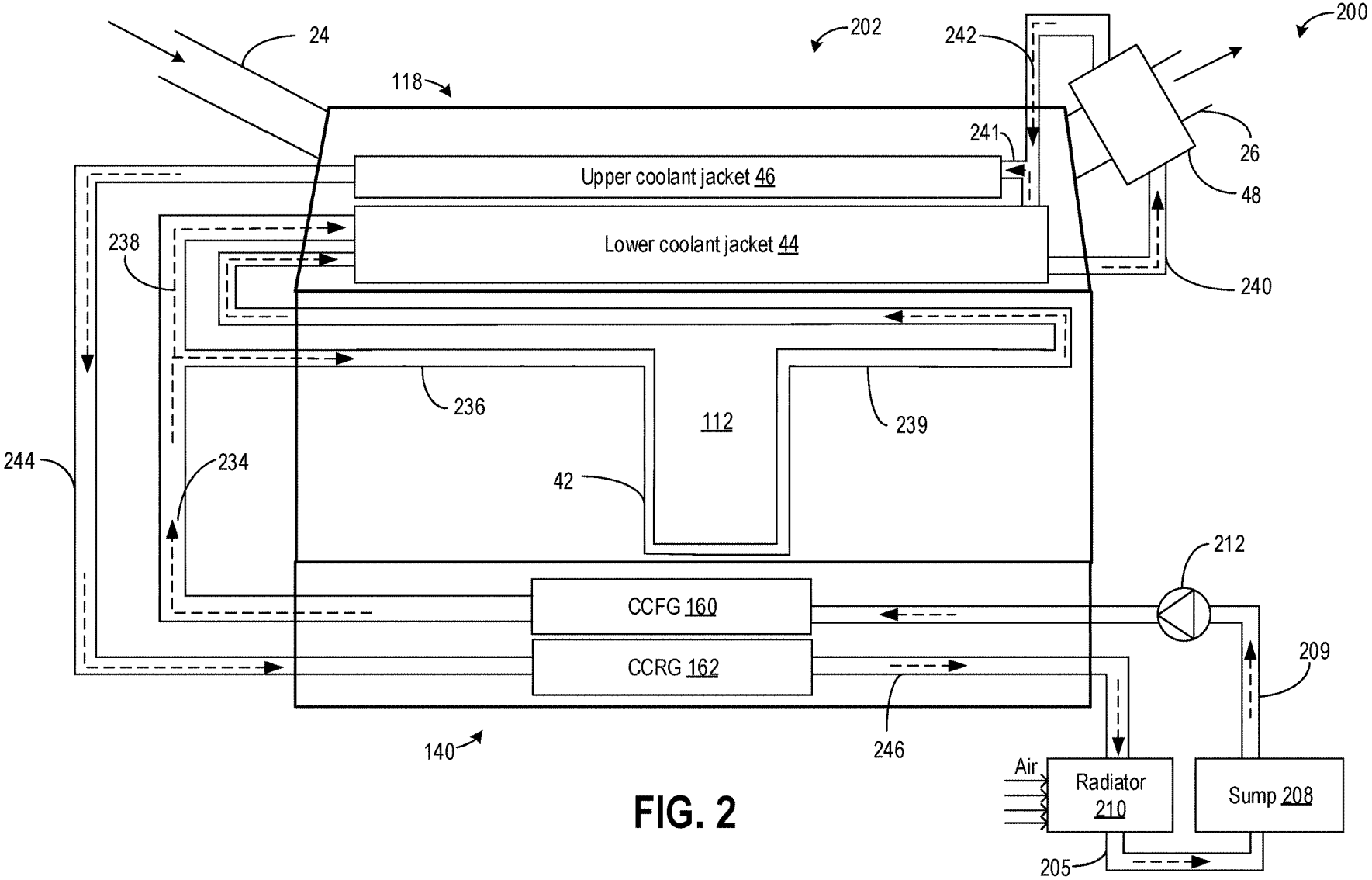
FIG. 2 shows an example embodiment of a coolant system circuit and the circulation of coolant through various locations of an engine block.

FIG. 2 is a block diagram 200 of an example coolant system 202 showing circulation of coolant through various locations of an engine block. Direction of coolant flow though the plurality of coolant lines in the coolant system 220 is shown by arrows. Components of the coolant system 220 previously introduced in FIG. 1 are numbered similarly and not reintroduced. In this example, a single combustion chamber 112 (within a cylinder liner in a cylinder bore) is shown along with a corresponding cylinder head 118. Intake port 24 and exhaust port 26 may be coupled to the combustion chamber 112. A crankcase housing 140 may encase the crankcases corresponding to each of the cylinders, the crankcase housing 140 enclosing each of the crankcase coolant feed gallery 160 and the crankcase coolant return gallery 162.

The coolant system includes a sump 208 such as reservoir wherein the coolant may be stored prior to being circulated via the engine components. After circulation through the engine components the coolant may return to a radiator 210 which may be in fluidic communication with the atmosphere and heat accumulated by the coolant while flowing through the engine components may be dissipated to the atmosphere (at the radiator).

Once the temperature of coolant in the radiator 210 reduces to below a threshold temperature, the coolant may flow from the radiator 210 to the sump 208 via a coolant supply line 205. As an example, the threshold coolant temperature may correspond to a temperature at which heat may be adsorbed from the metal engine components. The threshold coolant temperature may be pre-calibrated based on the coefficient of specific heat of the coolant and the metal used to form the engine block. In one example, a valve may be positioned in the coolant supply line 205 to facilitate return of the coolant to the sump 208 after cooling.

Coolant from the sump 208 may flow to the crankcase coolant feed gallery 160 via a first coolant line 209. During engine operation, pump 212 may be activated by the controller to flow coolant from the sump 208 to the crankcase coolant feed gallery 160. Coolant may flow out of the feed gallery 160 via a main coolant feed line 234. The main coolant feed line 124 may bifurcate into a first coolant feed line 236 supplying a first portion of coolant from the feed galley 160 to a cylinder liner coolant jacket 42 and a second coolant feed line 238 supplying a second portion of coolant from the feed gallery 160 to a lower coolant jacket 44. In one example, each of the first coolant feed line 236 and the second coolant feed line 238 may originate from the feed gallery 160.

As an example, a pump may be coupled to the coolant feed gallery 160 to pump coolant from the feed gallery 160 to each of the cylinder liner coolant jacket 42 and the lower coolant jacket 44. A proportioning valve may be coupled to the main coolant feed line 234, downstream of the feed gallery 160, for varying a ratio for coolant flow directed to the cylinder liner coolant jacket 42 relative to the lower coolant jacket 44. The ratio may be based on a temperature of the cylinder liner relative to the temperature of the cylinder head.

After flowing through the cylinder liner coolant jacket 42, the coolant may flow to the lower coolant jacket 44 via a third coolant feed line 239. In this way, coolant may flow to the lower coolant jacket 44 via two inlets, a first one from the cylinder liner coolant jacket 42 while a second one directly from the feed gallery 160. The lower coolant jacket 44 may also have two outlets, a first outlet 240 directing a first portion of coolant from the lower coolant jacket 44 to an exhaust port cooling jacket while a second outlet 241 directing a second portion of coolant from the lower coolant jacket 44 to an upper coolant jacket 46.

After flowing through the exhaust port cooling jacket 48, the coolant may be routed to the upper coolant jacket 46 via a fourth coolant feed line 242. In this way, the entire volume of coolant flowing through each of the cylinder liner coolant jacket 42, the lower coolant jacket, and the exhaust port cooling jacket 48 may be routed to the upper coolant jacket 46. From the upper coolant jacket 46, the entire volume of coolant may return to the crankcase coolant return gallery 162 gallery via main coolant return line 244. Since the coolant returns to the crankcase coolant return gallery 162 after absorbing thermal energy from the aforementioned engine components, the temperature of coolant at the crankcase coolant return gallery 162 may be higher than the temperature of coolant at the crankcase coolant feed gallery 160. In order to cool the coolant prior to recirculating the coolant to the sump 208, the coolant may be routed from the crankcase coolant return gallery 162 to the radiator 210. As described previously, at the radiator 210, in contact with ambient air, heat from the coolant may dissipate to the atmosphere.

Figure 3:
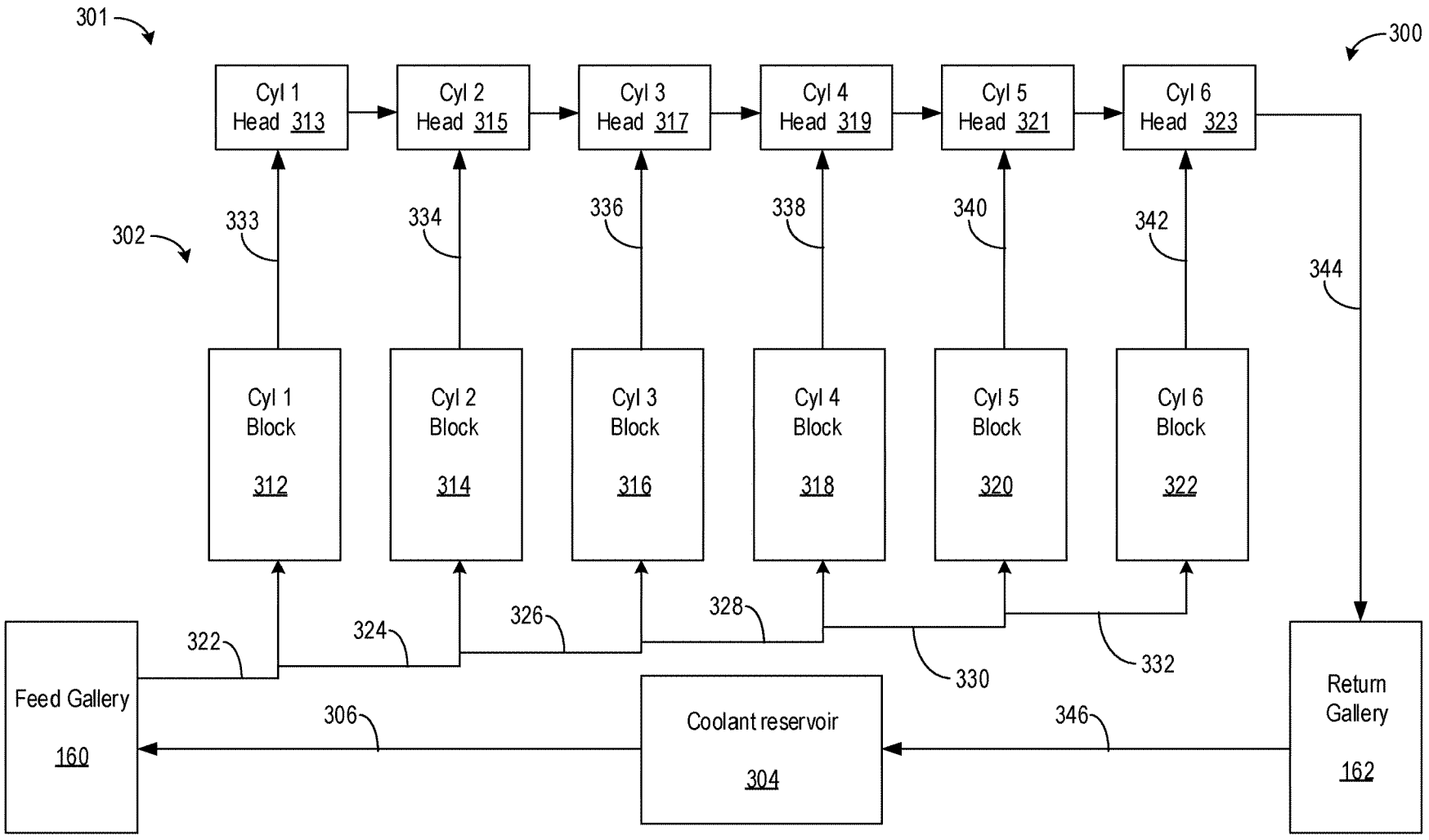
FIG. 3 shows a block diagram representation of the coolant system circuit of FIG. 2.

FIG. 3 shows a block diagram 300 representation of a circuit 301 of the coolant system circuit of FIG. 2. Components of the coolant system previously introduced in previous figures are numbered similarly and not reintroduced.

In this example, engine block 302 may include six individual cylinder blocks 312, 314, 316, 318, 320, and 322 with each cylinder block including a cylinder bore, a cylinder liner outlining the bore and a cylinder liner coolant jacket. Each cylinder block may be coupled to a corresponding cylinder head. In this example, six cylinder heads 313, 315, 317, 319, 321, and 323 are shown with each cylinder head including a lower cooling jacket, an upper cooling jacket, and an exhaust port cooling jacket.

The coolant system circuit 301 may include a coolant reservoir 304 wherein coolant may be stored prior to circulation through the engine block 302. In one example, coolant reservoir 304 may be the sump 208 in FIG. 2. During engine operation, coolant from the reservoir 304 may flow to a feed gallery 160, positioned in a crankcase housing, via a coolant line 209. From the feed gallery 160, coolant may simultaneously flow to each of the cylinder blocks 312, 314, 316, 318, 320, and 322 via respective distinct first coolant feed lines 322, 324, 326, 328, 330, and 332.

In one example, a single pump downstream of the feed gallery may direct coolant from the feed gallery 160 to each of the cylinder blocks 312, 314, 316, 318, 320, and 322 via each of the first coolant feed lines 322, 324, 326, 328, 330, and 332. A proportioning valve may be coupled downstream of the pump for varying a ratio for coolant flow directed to each of the first coolant feed lines 322, 324, 326, 328, 330, and 332. Alternatively, each of the first coolant feed lines 322, 324, 326, 328, 330, and 332 may include valves which may be individually actuated based on the cooling needs of the corresponding cylinder block and cylinder head to vary an amount of coolant flowing through each of the first coolant feed lines 322, 324, 326, 328, 330, and 332. As an example, a higher amount of coolant may be directed to the cylinder with the highest temperature. Also, during conditions when a cylinder is deactivated, coolant may not be routed to that cylinder.

In another example, each of the coolant feed lines 322, 324, 326, 328, 330, and 332 may include separate pumps facilitating concurrent flow of coolant from the feed gallery 160 to each of the cylinder blocks 312, 314, 316, 318, 320, and 322. From each of the cylinder blocks 312, 314, 316, 318, 320, and 322, the coolant may flow to their corresponding cylinder heads 313, 315, 317, 319, 321, and 323 via respective distinct second coolant feed lines 333, 334, 336, 338, 340, and 342. After flowing through a lower cooling jacket, an upper cooling jacket, and an exhaust port cooling jacket housed in each of the cylinder heads 313, 315, 317, 319, 321, and 323, the coolant may return to a return galley 162 from each of the cylinder heads 313, 315, 317, 319, 321, and 323 via a common coolant return line 344. From the return galley 162, the coolant may be routed back to the coolant reservoir 304 via a radiator and a second coolant line 346.

In this way, a coolant system for an engine, may comprise: a coolant feed gallery 160 coupled inside an engine crankcase; a coolant return gallery 162 coupled inside the engine crankcase; a first cooling unit including a cylinder liner jacket surrounding a first cylinder, an upper coolant jacket and a lower coolant jacket surrounding a head of the first cylinder, and an exhaust port cooling jacket coupled to an exhaust port of the first cylinder; and a second cooling unit including another cylinder liner jacket surrounding a second cylinder, another upper coolant jacket and another lower coolant jacket surrounding a head of the second cylinder, and another exhaust port cooling jacket coupled to an exhaust port of the second cylinder, wherein each of the first and the second cooling unit is coupled to the coolant feed gallery and the coolant return gallery.

Figure 4:
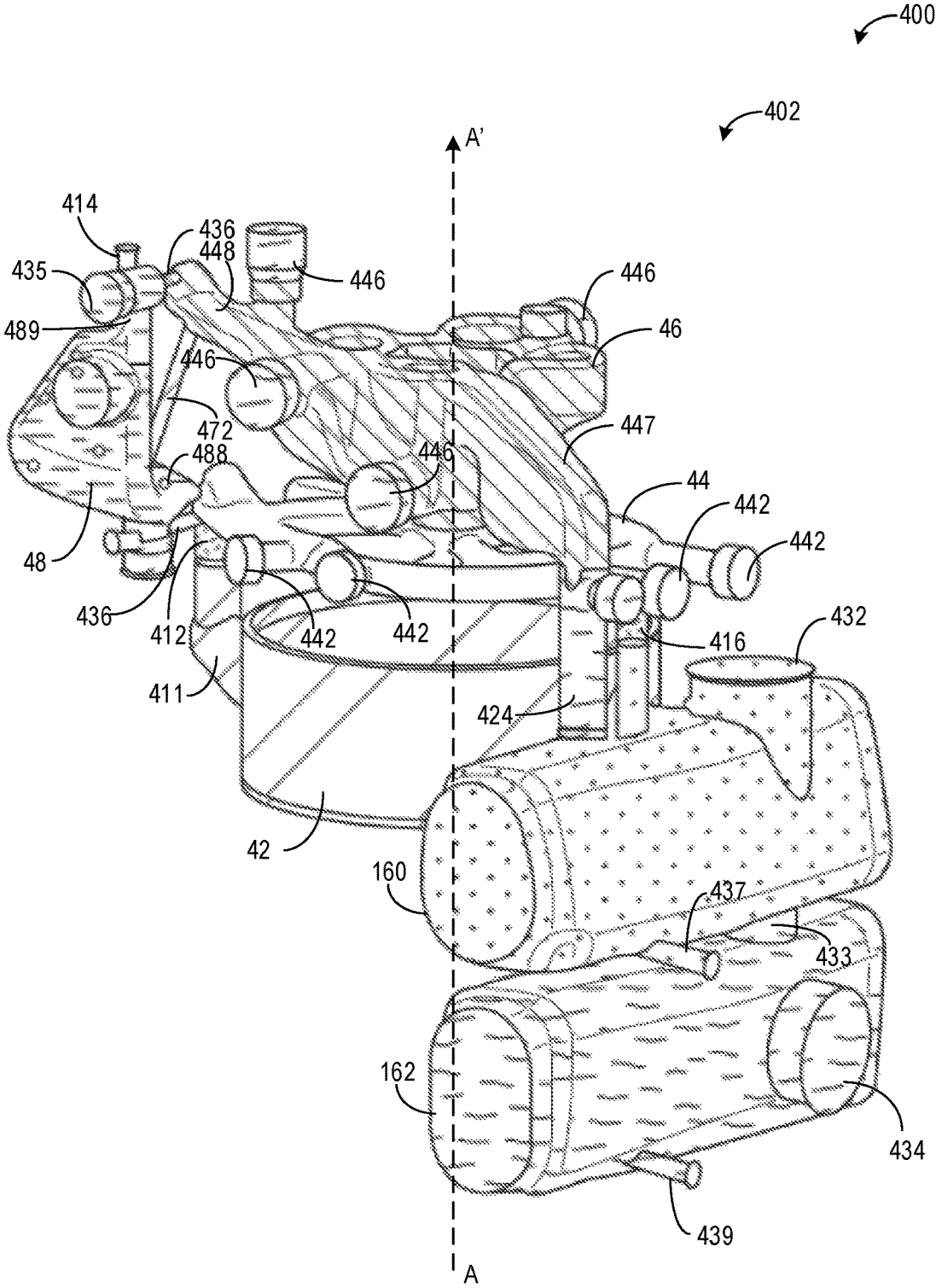
FIG. 4 shows a perspective view of the coolant system of FIG. 2.

FIG. 4 shows a perspective view 400 of a portion 402 of the coolant system of FIG. 2 coupled to a single cylinder in an engine block. In this example, the cylinder is not shown but the central axis of the cylinder system is marked by the axis A-A'. The cylinder may be radially symmetric around the A-A' axis. Components of the coolant system previously introduced in are numbered similarly and not reintroduced.

A coolant feed gallery 160 may be positioned within a crankcase housing below the cylinder. A main coolant feed line may fluidically couple the feed gallery 160 to a sump (coolant reservoir) and coolant may flow to the feed gallery 160 via the main coolant feed line prior to being circulated through the engine components. The main coolant feed line may be coupled to side surface of the feed gallery 160, the main coolant feed line parallel to the radius of the cylinder (in the direction perpendicular to the A-A' axis). Components 432, 434, 437, 439, and 433 provide core support and are added for casting manufacturability.

Directly below the coolant feed gallery 160, a coolant return gallery 162 may be positioned within the crankcase housing. A main coolant return line (not shown) may fluidically couple the coolant return galley 162 to a radiator and warm coolant accumulated in the return gallery (after flowing through the engine components) may flow to the radiator. Each of the coolant feed gallery 160 and the coolant return gallery 162 may be aligned to a first side of the central A-A' axis and the cylinder. The coolant system may include a single coolant feed gallery 160 coupled to coolant lines feeding coolant to different coolant system components corresponding to each cylinder. Similarly, coolant from each of the coolant system components coupled to each cylinder may return to a single coolant return gallery 162.

In one example, each of the coolant feed gallery 160 and the coolant return gallery 162 may be shaped as elongated cuboids with the edges of the coolant feed gallery 160 being coplanar with the edges of the coolant return gallery 162.

A cylinder liner jacket 42 may enclose the cylinder liner of the cylinder like a sleeve. The cylinder liner jacket 42 may include an outer cylindrical surface, an inner cylindrical surface, and a space defined between the inner and outer surface for circulating coolant, each of the inner and outer surface surrounding the cylinder. The cylinder liner jacket 42 may be fluidically coupled to the feed gallery 160 via a first coolant feed line (not shown) positioned between the feed galley 160 and a side of the cylinder liner jacket 42 facing the feed gallery 160 (on the first side of the cylinder). Also, the cylinder liner jacket 42 may be fluidically coupled to a lower coolant jacket 44 via a first coolant passage 412. The first coolant passage 412 may originate from a conical protrusion 411 in the wall of the cylinder liner jacket 42.

The coolant system may include each of a lower coolant jacket 44 surrounding a lower surface of a cylinder head placed over the cylinder and an upper coolant jacket 46 surrounding an upper surface of the cylinder head. The lower coolant jacket 44 may be positioned directly above the cylinder liner jacket 42 while the upper coolant jacket 46 may be positioned directly above the lower coolant jacket 44, each of the cylinder liner jacket 42, the lower coolant jacket 44, and the upper coolant jacket 46 may be coaxial with the central axis A-A'. The lower coolant jacket 44 may be a circularly formed hollow pipe with coolant flowing there through. A plurality of plurality of cylindrical structures 442 adding core support may radially protrude from the lower coolant jacket 44. Each cylindrical structure 442 may include a circular cap at the end (away from the lower coolant jacket 44).

The lower coolant jacket 44 may be fluidically coupled to each of the coolant feed gallery 160, the upper coolant jacket 46, and an exhaust port cooling jacket 48. A first inlet of the lower coolant jacket may be coupled to the cylinder liner jacket 42 via the first coolant passage 412 positioned on a second side of the central axis (and the cylinder) while a second inlet of the lower coolant jacket may be coupled to the coolant feed gallery 160 via a second coolant passage 416 positioned on the first side of the central axis, opposite the second side. A first outlet of the lower coolant jacket may be coupled to the upper jacket 46 via a third coolant passage positioned on the first side of the central axis while a second outlet of the lower coolant jacket may be coupled to the exhaust port cooling jacket 48 via a fourth coolant passage positioned on the second side of the central axis.

The upper coolant jacket 46 includes a central circular structure with a plurality of cylindrical structures 446 radially protruding from the central circular structure. The upper cooling jacket may include a first projection 447 extending down and outwards from a top surface of the central circular structure towards a top surface of the lower coolant jacket on the first side of the central axis. The first projection 447 may extend into a coolant return passage 424 coupling the upper coolant jacket 46 with the coolant return gallery 162. The coolant return passage 424 may be parallel to the second coolant passage 416 and the central axis. The upper coolant jacket 46 may further include a second projection 448 extending outwards from the top surface of the central circular structure towards a top surface of an exhaust cooling port cooling jacket 48 on the second side of the central axis. In this example, the first projection 447 may extend in a direction opposite to the second projection 448, each of the first and second projections extending along a projection axis that is perpendicular to the central axis.

The cylinder head exhaust port cooling jacket 48 may be coupled between the upper and lower coolant jacket, and offset to the second side of the central axis. The exhaust port cooling jacket may be an elongated hollow structure through which coolant may flow. An inlet of the exhaust port cooling jacket 48 may be in fluidic communication with the second outlet of the lower coolant jacket 44 via the fourth coolant passage. The inlet of the exhaust port cooling jacket 48 may be positioned on a lower surface 488 of the exhaust port cooling jacket 48, the lower surface 488 coplanar with the lower coolant jacket 44. A cylinder venting hole 414 may be mounted atop of the coolant jacket in cylinder head.

In one example, coolant from the feed gallery 160 may simultaneously flow to the cylinder liner coolant jacket 42 and the lower cooling jacket 44 via a first coolant feed line (not shown) and the second coolant passage 416, respectively. From the cylinder liner coolant jacket 42, the coolant may flow to the lower coolant jacket 44 via the first coolant passage 412. Then the coolant may be simultaneously routed from the lower coolant jacket 44 to the upper coolant jacket 46 and the exhaust port cooling jacket 48 via the third coolant passage and the fourth coolant passage respectively. From the exhaust port cooling jacket 48, the coolant may also be routed to the upper coolant jacket 46 via the fifth coolant passage 436. Finally, the coolant may flow from the upper coolant jacket 46 to the coolant return galley 162 via the coolant return passage 424. In this way, the components of FIGS. 1-4 enable a coolant system for a cylinder of an engine, comprises: a cylinder liner jacket encircling the cylinder and configures to circulate coolant around a liner of the cylinder, a central axis of the liner jacket coaxial with a central axis of the encircled cylinder, a coolant feed gallery positioned within a crankcase below the cylinder, a coolant return gallery positioned within the crankcase, below the coolant feed gallery, a cylinder head lower coolant jacket surrounding a lower surface of a cylinder head positioned over the cylinder, the lower coolant jacket positioned above and coaxial with the liner jacket and, a cylinder head upper coolant jacket surrounding an upper surface of the cylinder head, the upper coolant jacket positioned above the lower coolant jacket, the upper coolant jacket including a central piece that is coaxial with the liner jacket, and a cylinder head exhaust port cooling jacket coupled between the upper coolant jacket and the lower coolant jacket, and offset to one side of the central axis, wherein the lower coolant jacket is fluidically coupled to each of the coolant feed gallery, the upper coolant jacket, the cylinder liner jacket, and the exhaust port cooling jacket.

Figure 5:
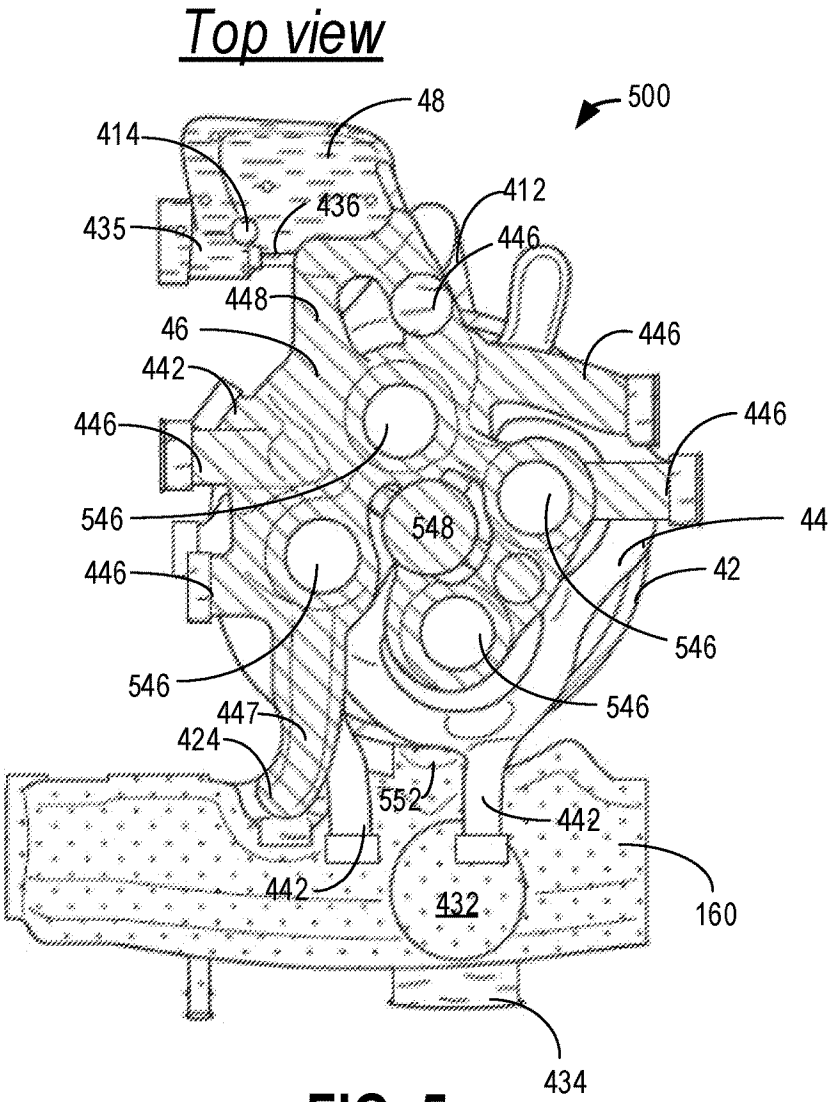
FIG. 5 shows a top view of the coolant system.

FIG. 5 shows a top view (from above a cylinder head) 500 of the coolant system of FIG. 2 coupled to a single cylinder in an engine block. Components of the coolant system previously introduced in previous figures are numbered similarly and not reintroduced.

The upper coolant jacket 46 may include a central solid disc 548 and four circular cavities 546 arranged on a top surface of the upper coolant jacket 46. The four circular cavities 546 may be symmetrically distributed around the central disc 548. A plurality of cylindrical structures 446 structures 446 may radially protrude outward from the top surface of the upper coolant jacket 46. Each of the cylindrical structures 446 may include a rod-like component with an end cap.

A first projection 447 may extend outwards from the top surface of the upper coolant jacket 46 to a coolant return passage 424 coupling the upper coolant jacket 46 with the coolant return gallery. A second projection 448 may extend outwards from the top surface of the upper coolant jacket 46 and may couple the upper coolant jacket 46 to outlet core support component 435 via a coolant passage 436. A cylinder venting hole 414 may be positioned on the exhaust port cooling jacket 48.

The upper coolant jacket 46 may be co-axial with the lower coolant jacket 44 and the cylinder liner coolant jacket 42. The lower coolant jacket 44 may also include a plurality of cylindrical structures 442 radially protruding outward from the center of the lower coolant jacket 44. The cylindrical structures 446 corresponding to the upper coolant jacket 46 may not overlap with the cylindrical structures 442 corresponding to the lower coolant jacket 44.

The coolant feed galley 160 may be positioned on a first side of each of the upper coolant jacket 46, the lower coolant jacket 44, and the cylinder liner coolant jacket 42 while the exhaust port cooling jacket may be positioned on a second side of each of the upper coolant jacket 46, the lower coolant jacket 44, and the cylinder liner coolant jacket 42, the second side diametrically opposite to the first side. The first coolant feed line 552 is shown coupling the feed gallery 160 to the cylinder liner coolant jacket 42 while the first coolant passage 412 is shown coupling the cylinder liner jacket 42 to the lower coolant jacket 44. A main coolant feed line may supply coolant to the feed gallery 160. Since the coolant return galley is housed directly under the feed gallery 160 and the shape and size of the coolant return galley and the coolant feed galley 160 are substantially equal, view of the return the coolant return gallery is obstructed.

Figure 6:
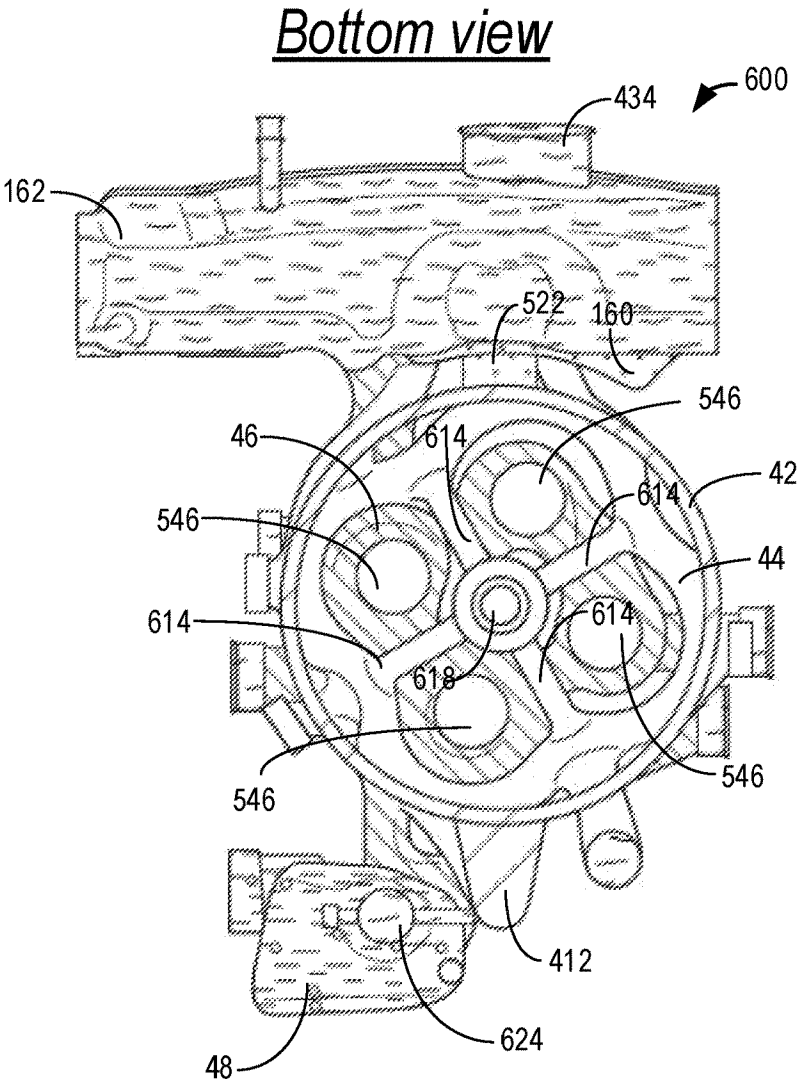
FIG. 6 shows a bottom view of the coolant system.

FIG. 6 shows a bottom view (from below the cylinder) 600 of the coolant system of FIG. 2 coupled to a single cylinder in an engine block. Components of the coolant system previously introduced in previous figures are numbered similarly and not reintroduced.

The co-axial components including the cylinder liner coolant jacket 42, the lower coolant jacket 44, and the upper coolant jacket are stacked over one another (in this order). Each of the cylinder liner coolant jacket 42, the lower coolant jacket 44, and the upper coolant jacket may be of a similar diameter. Since the cylinder liner coolant jacket 42 is completely hollow (enclosing a cylinder, not shown here), the lower coolant jacket 44 is visible though the cylinder liner coolant jacket 42. The lower coolant jacket 44 may include a central disc 618 which may be directly under the central solid disc of the upper coolant jacket 46. Four spokes 614 may connect the central disc 618 to a curved, circular boundary of the lower coolant jacket 44. Two adjacent spokes 614 form a right angle. The spokes 614 do not overlap with the circular cavities 546 of the upper coolant jacket 46 and each circular cavity 546 is visible between two adjacent spokes 614. Coolant flow through the spokes 614 intend to cool valve seats.

The coolant return galley 162 may be positioned on a first side of each of the upper coolant jacket 46, the lower coolant jacket 44, and the cylinder liner coolant jacket 42 while the exhaust port cooling jacket 48 may be positioned on a second side of each of the upper coolant jacket 46, the lower coolant jacket 44, and the cylinder liner coolant jacket 42, the second side diametrically opposite to the first side. Since the coolant return galley 162 is housed directly below the feed gallery, view of the feed gallery is obstructed. The first coolant feed line 552 is shown coupling the feed gallery to the cylinder liner coolant jacket 42 and the first coolant passage 412 is shown coupling the cylinder liner jacket 42 to the lower coolant jacket 44. The first coolant feed line 552 may be positioned diametrically opposite to the first coolant passage 412 with the first coolant feed line 552 being proximal to the return gallery 162 and the first coolant feed line 552 being proximal to the exhaust port cooling jacket 48.

Figure 7:
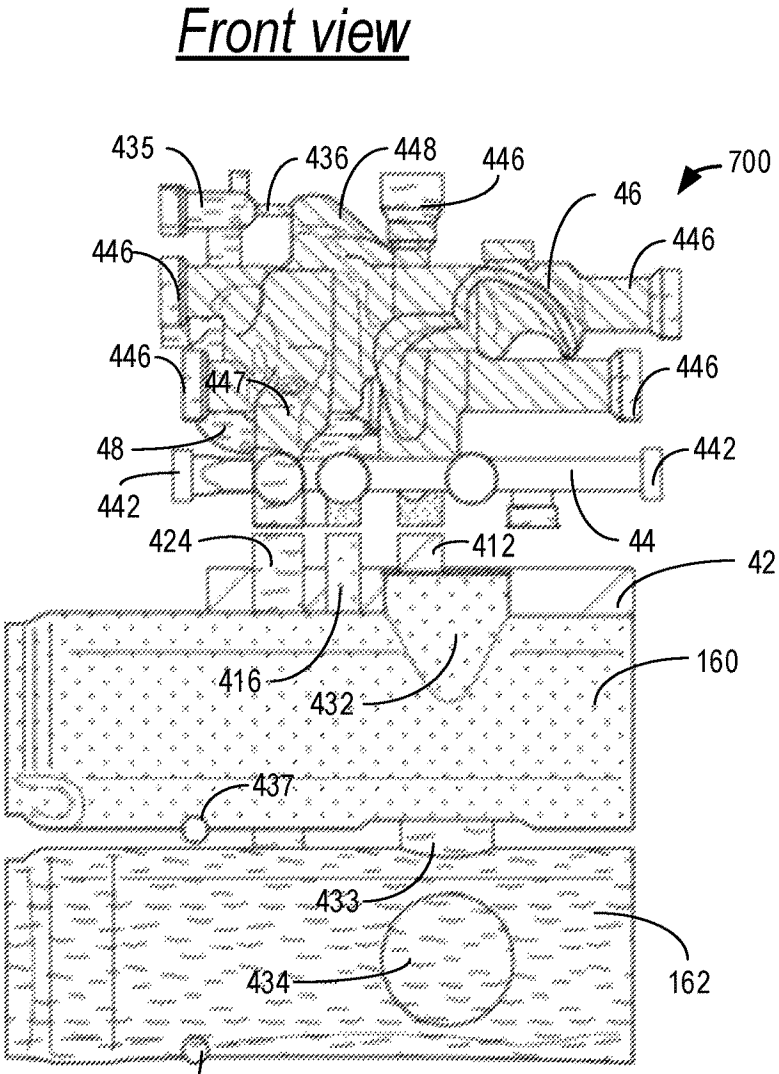
FIG. 7 shows a front view of the coolant system.

FIG. 7 shows a front side view 700 of the coolant system of FIG. 2 coupled to a single cylinder in an engine block. Components of the coolant system previously introduced in previous figures are numbered similarly and not reintroduced.

A first surface (distal from the cylinder) of the feed galley 160 may be coplanar with a first surface of the return gallery 162 (distal from the cylinder) with the feed galley 160 positioned directly above the return gallery 162. A main coolant return line may flow warm coolant accumulated in the return gallery (after flowing through the engine components) to the radiator. A main coolant feed line may be coupled to a second (side) surface of the feed galley 160 to flow coolant from the sump to the feed gallery 160 prior to being circulated through the engine components The feed galley 160 may be positioned next to the cylinder liner jacket 42 on a first side of the cylinder liner jacket 42. The lower coolant jacket 44 is placed immediately above the cylinder liner jacket 42 and the upper coolant jacket 46 may be positioned immediately above the lower coolant jacket 44. The coolant passage 416 coupling the lower coolant jacket 44 to the coolant feed gallery 160 is seen to project out of a third surface of the feed galley 160 (proximal to the cylinder liner coolant jacket 42). Also, a coolant passage 412 is seen coupling the cylinder liner jacket 42 to the lower coolant jacket 44.

A first projection 447 is seen originating from the central portion of the upper coolant jacket 46 and extending down and outwards to the coolant return passage 424 coupling the upper coolant jacket 46 with the coolant return gallery 162. A second projection 448 is seen originating from the central portion of the upper coolant jacket 46 and extending outwards from the central portion of the upper coolant jacket 46. The first projection 447 and the second projection 448 may be diametrically opposite to one another. The second projection 448 may be fluidically coupled, via a coolant passage 436, to an outlet of the exhaust port cooling jacket 48 and the upper coolant jacket may receive coolant form the exhaust port cooling jacket 48 via the second projection 448. A first set of cylindrical structures 446 may protrude from the upper coolant jacket 46 and a second set of cylindrical structures 442 may protrude from the lower coolant jacket 44.

The exhaust port cooling jacket 48 may be positioned next to the upper coolant jacket 46 on a second side of the upper coolant jacket 46. The feed galley 160 and the return galley 162 may be positioned on opposite sides of the cylinder.

Figure 8:
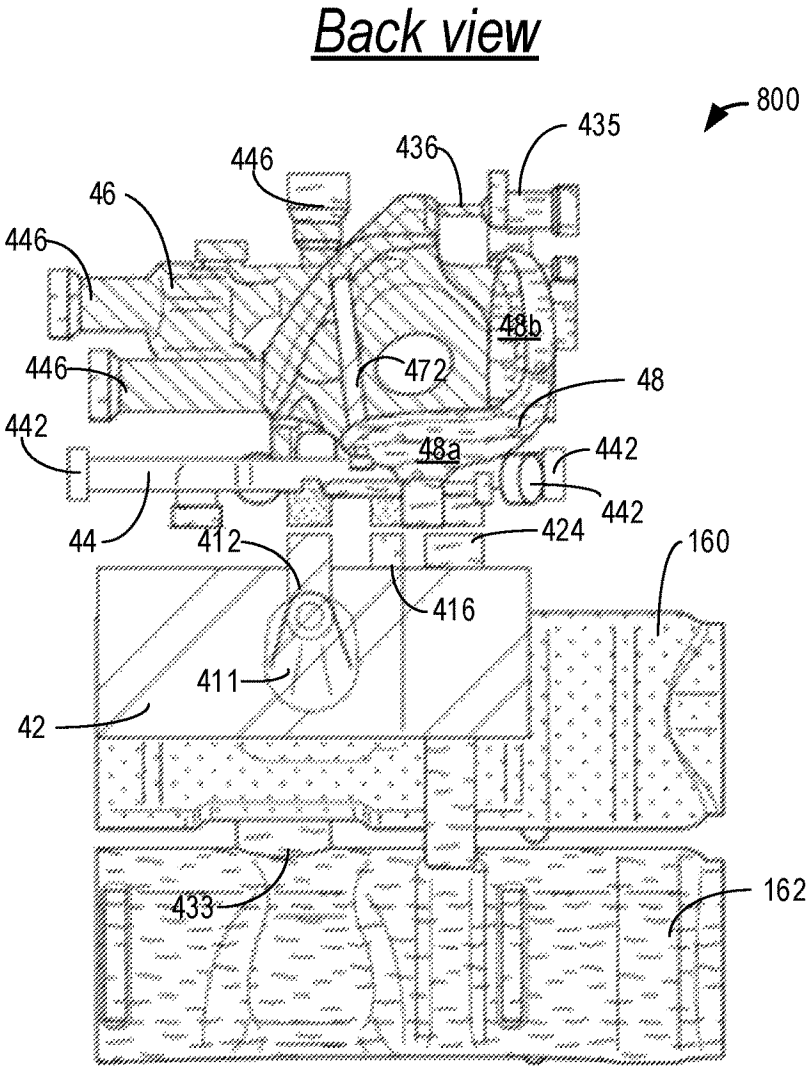
FIG. 8 shows a back view of the coolant system.

FIG. 8 shows a back view 800 of the coolant system of FIG. 2 coupled to a single cylinder in an engine block.

Components of the coolant system previously introduced in previous figures are numbered similarly and not reintroduced.

A third surface (proximal to the cylinder) of the feed galley 160 may be coplanar with a third surface of the return gallery 162 (proximal to the cylinder) with the feed galley 160 positioned directly above the return gallery 162. A coolant return passage 424 may be coupled to the third side of the return gallery 162 via which coolant may return to the return galley 162 after flowing through each of the cylinder liner coolant jacket 42, the lower coolant gallery 44, the upper coolant galley 46, and the exhaust port cooling jacket 48.

The cylinder liner coolant jacket 42 may partly obstruct the third surface of the feed galley 160. A coolant passage 412 coupling the cylinder liner coolant jacket 42 to the lower coolant jacket 44 may originate from a conical protrusion 411 on the wall of the cylinder liner jacket 42 facing away from the feed gallery 160. The lower coolant jacket 44 is placed immediately above the cylinder liner jacket 42 and the upper coolant jacket 46 may be positioned immediately above the lower coolant jacket 44. A first set of cylindrical structures 446 is seen protruding from the upper coolant jacket 46 while a second set of cylindrical structures 442 is seen protruding from the lower coolant jacket 44. The coolant passage 416 coupling the lower coolant jacket 44 to the coolant feed gallery 160 is seen behind the cylinder liner jacket 42.

The exhaust port cooling jacket 48 may be shaped as a chair including a seat 48*a* and a back 48*b*. The exhaust port may pass through the region between the seat 48*a* and the back 48*b*. A rod-shaped drilling 472 is seen couple the upper coolant jacket 46 to the seat portion 48*a* of the exhaust port cooling jacket 48.

Figure 10:
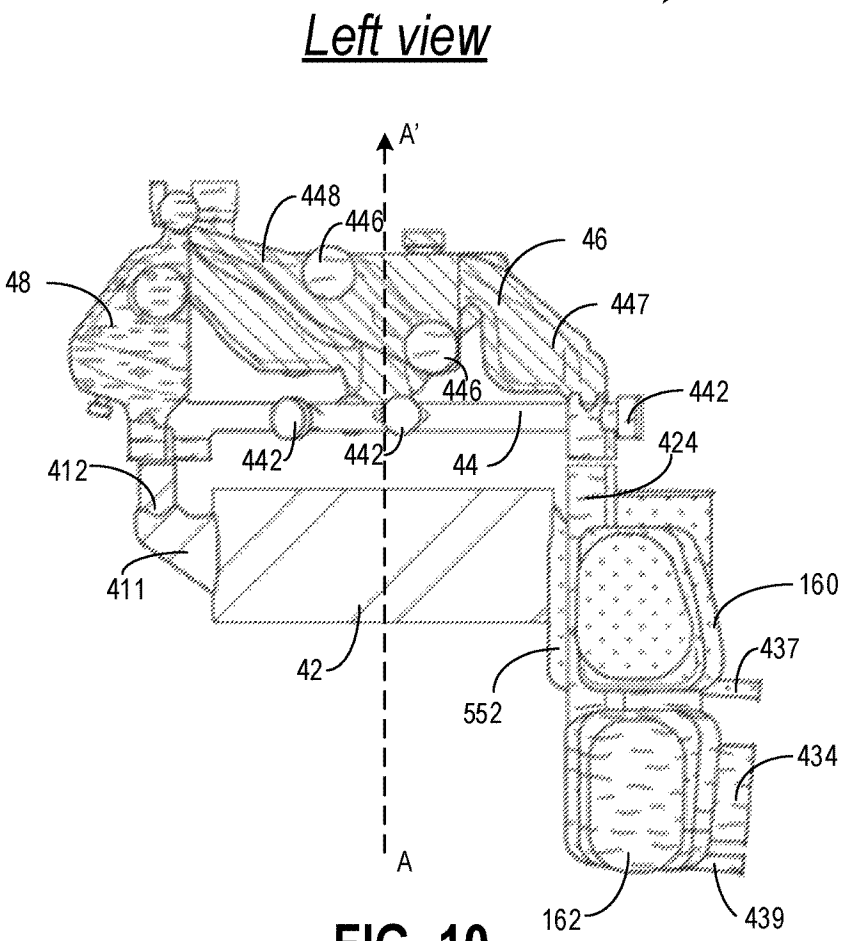
FIG. 10 shows an isometric view of the coolant system when viewed from the right side.
Figure 9:
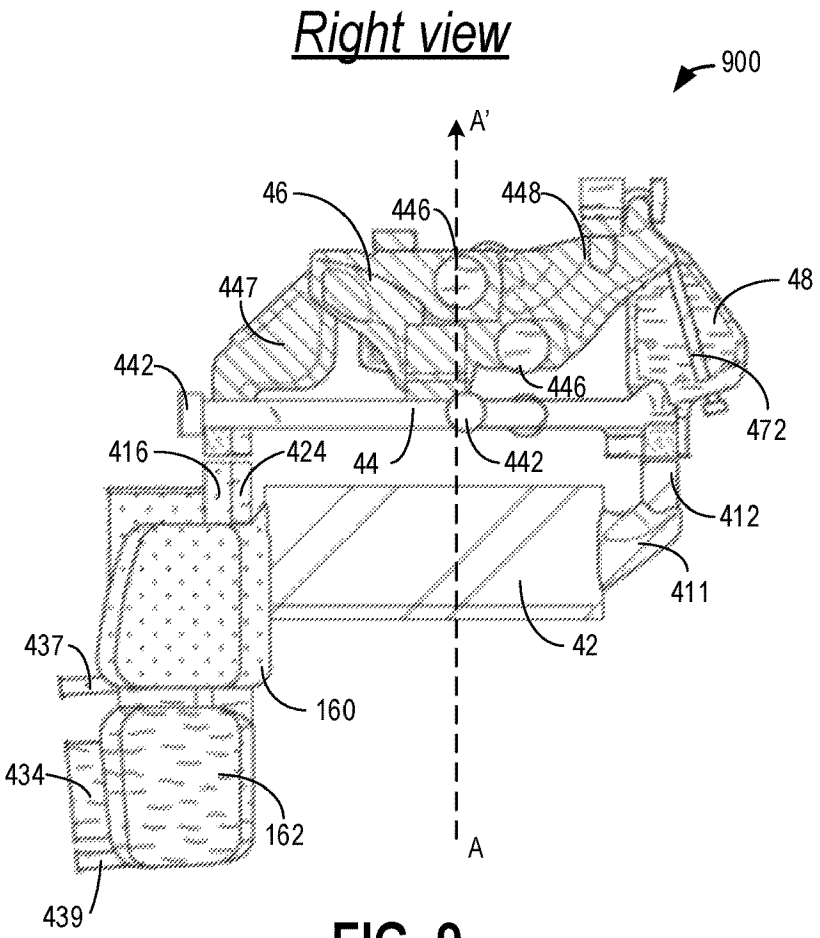
FIG. 9 shows an isometric view of the coolant system when viewed from the left side.

FIG. 9 shows a right side view 900 and FIG. 10 shows a left side view 1000 of the coolant system of FIG. 2 coupled to a single cylinder in an engine block. Components of the coolant system previously introduced in previous figures are numbered similarly and not reintroduced. The central axis of the cylinder is shown by dashed line A-A'.

In each of the views, the coolant feed galley 160 is seen to be positioned immediately atop the coolant return gallery 162. In the right side view, the right end faces of each of the coolant feed galley 160 and the coolant return gallery 162 are seen while in the left side view, the left end faces of each of the coolant feed galley 160 and the coolant return gallery 162 are visible. In the right side view, view of the return passage 424 is partially obstructed via a coolant passage 416 coupling the coolant feed gallery 160 to the lower coolant jacket 44 while in the left side view, view of the coolant passage 416 is obstructed by the return passage 424. The return passage 424 and the coolant passage 416 may be parallel to each other and to the central axis A-A'.

While the coolant feed galley 160 and the return gallery 162 are positioned on a first side of the central axis A-A', each of the cylinder liner coolant jacket 42, the lower coolant jacket 44, and the upper coolant jacket 46 may be symmetric around the central axis A-A'. The exhaust port cooling jacket 48 may be positioned on a second side of the central axis A-A', opposite to the first side.

A coolant passage 412 coupling the cylinder liner coolant jacket 42 to the lower coolant jacket 44 is seen originating from a conical protrusion 411 on the wall of the cylinder liner jacket 42. A first set of cylindrical structures 446 is seen radially protruding from the upper coolant jacket 46 while a second set of cylindrical structures 442 is seen radially protruding from the lower coolant jacket 44. A first projection 447 of the upper coolant jacket 46 is seen extending in a direction opposite to a second projection 448, each of the first and second projections extending along a projection axis that is perpendicular to the central axis.

A front face of the exhaust port cooling jacket 48 is visible in the right side view while a back face of the exhaust port cooling jacket 48 is seen in the left side view. A rod-shaped drilling 472 is visible across the front face of the exhaust port cooling jacket 48, the drilling 472 coupling the upper coolant jacket 46 to the exhaust port cooling jacket 48. The rod-shape may correspond to an elongated cylindrical shape with a high aspect ratio (ratio between length and diameter).

Figure 11:
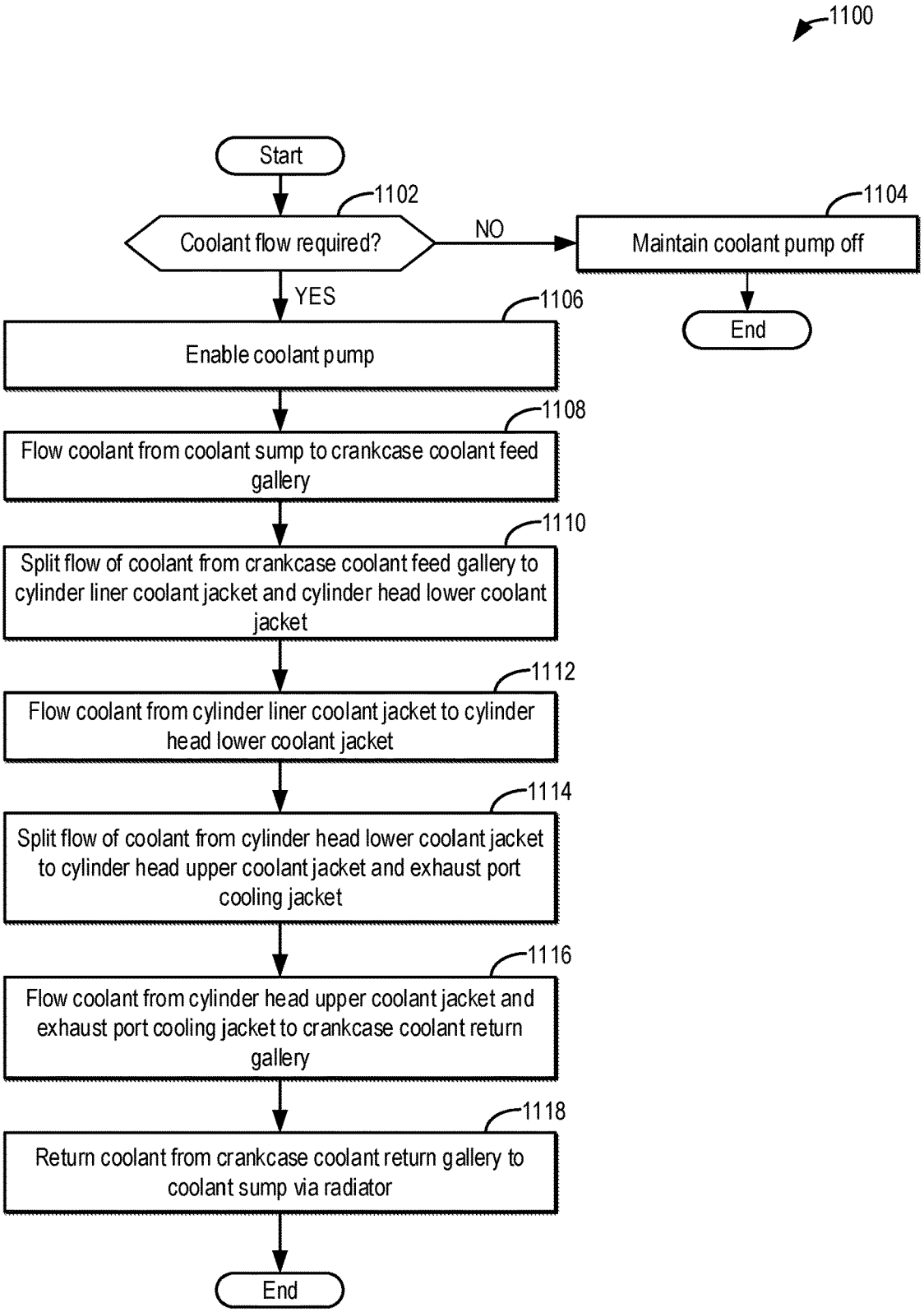
FIG. 11 shows a high level flow chart of an example method of circulating coolant through a cylinder head and an engine block via the coolant system of FIGS. 4-10.

Turning now to FIG. 11, an example method 1000 is described for circulating coolant through a cylinder head and an engine block via the coolant system of FIGS. 4-10. Instructions for carrying out method 1100 may be executed by a controller based on instructions stored on a memory of the controller and in conjunction with signals received from sensors of the vehicle system. The controller may employ actuators of the vehicle system to adjust coolant flow through engine components, according to the methods described below.

At 1102, the routine includes determining if coolant flow is required. Coolant flow may be required if the engine is operational such as combusting fuel and air. Combustion creates heat which causes engine components to warm up. Excessive heating of the engine components may increase engine wear and fuel consumption. Coolant flow through (or around) engine components including the cylinder heads and the cylinder liners may cause thermal energy from the engine components to be transferred to the coolant, thereby cooling the engine components. Coolant flow may not be required when the engine is in a non-combusting condition such as during a vehicle off condition or when the vehicle is being propelled via machine torque.

If it is determined that coolant flow is not required, at 1104, a coolant pump (such as pump 212 in FIG. 2) coupled to a first coolant line (such as coolant line 209 in FIG. 2) connecting a coolant sump (such as sump 208 in FIG. 2) to a coolant feed galley (such as feed gallery 160 in FIG. 2) may be maintained in an off state. While in the off state, coolant may not be routed from the sump to the feed gallery.

If it is determined that coolant flow is required, at 1106, the controller may send a signal to an actuator coupled to the pump to enable the coolant pump. Upon operation of the pump, at 1108, coolant may flow from the coolant sump to the crankcase coolant feed gallery via the first coolant line. Prior to circulation through the coolant system, the coolant may be stored at the sump.

At 1110, from the crankcase coolant feed gallery, coolant flow may be split to simultaneously flow to a cylinder liner coolant jacket (such as cylinder liner coolant jacket 42 in FIG. 2) and to a cylinder head lower coolant jacket (such as lower coolant jacket 44 in FIG. 2). Coolant may flow out of the feed gallery via a main coolant feed line. The main coolant feed line may bifurcate into a first coolant feed line supplying a first portion of coolant from the feed galley to the cylinder liner coolant jacket and a second coolant feed line supplying a second portion of coolant from the feed gallery to a lower coolant jacket. In one example, each of the first coolant feed line and second coolant feed line may originate from the feed gallery.

In one example, coolant from the feed galley may be simultaneously directed to a plurality of cooling units encasing distinct cylinders such as a first cooling unit encasing a first cylinder block and an associated cylinder head and a second cooling unit encasing a second cylinder block and an associated cylinder head. The first and second cylinder blocks may be positioned adjacent to each other, each of the first and second cylinder block coupled to a crankcase. As an example, a first ratio of coolant flowing through the first cooling unit relative to the second cooling unit may be varied based on individual cylinder operating conditions. The first ratio may be varied by adjusting a proportioning valve coupled to the main coolant feed line, the valve adjusted to increase the first ratio relative to the second ratio if the as a cylinder head temperature of the first cylinder block exceeds the cylinder head temperature of the second cylinder block.

At 1112, coolant from the cylinder liner coolant jacket may be routed to the cylinder head lower cooling jacket. In this way, the lower coolant jacket may receive coolant from each of the cylinder liner coolant jacket and the feed gallery. At 1114, coolant from the cylinder head lower coolant jacket may be split to flow to each of a cylinder head upper coolant jacket (such as upper coolant jacket 44 in FIG. 2) and an exhaust port cooling jacket (such as exhaust port cooling jacket 48 in FIG. 2). The lower coolant jacket 44 may have two outlets, a first outlet directing a first portion of coolant from the lower coolant jacket to the exhaust port cooling jacket while a second outlet directing a second portion of coolant from the lower coolant jacket to the upper coolant jacket.

At 1116, coolant from the cylinder head upper coolant jacket and the exhaust port cooling jacket may be routed to crankcase coolant return gallery (such as return gallery 162 in FIG. 2). From the exhaust port cooling jacket, the coolant may flow to the upper coolant jacket via a fourth coolant feed line. From the upper coolant jacket, the entire volume of coolant may return to the crankcase coolant return gallery via a main coolant return line. As heat from the engine is transferred to the coolant circulating there through, coolant temperature increases. Therefore, the temperature of coolant in the coolant return gallery may be higher than the temperature of coolant in the coolant feed gallery.

At 1118, the coolant from the main coolant gallery may be returned to the sump via a radiator. At the radiator, the coolant may dissipate the heat adsorbed from the engine components and the coolant may return to the sump. The temperature of coolant entering the radiator may be higher than that of coolant exiting the radiator.

A method for cooling an engine may comprise: flowing coolant, drawn from a feed gallery coupled to a crankcase, through a first cooling unit encasing a first cylinder block and an associated cylinder head, concurrently flowing coolant, drawn from the feed gallery coupled to the crankcase, through a second cooling unit encasing a second cylinder block and an associated cylinder head, wherein the first and second cylinder block are positioned adjacent to each other, each of the first and second cylinder block coupled to the crankcase, and varying a first ratio of coolant flowing through the first cooling unit relative to the second cooling unit based on individual cylinder operating conditions.

An example coolant system for a cylinder of an engine comprises: a cylinder liner jacket encircling the cylinder and configures to circulate coolant around a liner of the cylinder, a central axis of the liner jacket coaxial with a central axis of the encircled cylinder, a coolant feed gallery positioned within a crankcase below the cylinder, a coolant return gallery positioned within the crankcase, below the coolant feed gallery, a cylinder head lower coolant jacket surrounding a lower surface of a cylinder head placed over the cylinder, the lower coolant jacket positioned above and coaxial with the liner jacket and, a cylinder head upper coolant jacket surrounding an upper surface of the cylinder head, the upper coolant jacket positioned above the lower coolant jacket, the upper coolant jacket including a central piece that is coaxial with the liner jacket, and a cylinder head exhaust port cooling jacket coupled between the upper and lower coolant jacket, and offset to one side of the central axis, wherein the lower coolant jacket is fluidically coupled to each of the coolant feed gallery, the upper coolant jacket, the cylinder liner jacket, and the exhaust port cooling jacket. In any preceding example, additionally or optionally, the lower coolant jacket being fluidically coupled to each of the coolant feed gallery, the upper coolant jacket, and the exhaust port cooling jacket includes the lower coolant jacket configured to receive coolant flow concurrently from each of the coolant feed gallery and the cylinder liner jacket, and to flow coolant concurrently from the lower coolant jacket to each of the upper coolant jacket and the exhaust port cooling jacket. In any or all of the preceding examples, additionally or optionally, the lower coolant jacket is configured to receive coolant from the cylinder liner jacket at a first inlet via a first coolant passage positioned on the one side of the central axis and wherein the lower coolant jacket is configured to receive coolant from the coolant feed gallery at a second inlet positioned diametrically opposite the first inlet, and via a second coolant passage positioned on another side of the central axis, opposite the one side. In any or all of the preceding examples, additionally or optionally, an inlet of the exhaust port cooling jacket for receiving coolant from the lower coolant jacket is positioned on a lower surface of the exhaust port cooling jacket, the lower surface coplanar with the lower coolant jacket, and wherein an outlet of the exhaust port cooling jacket for directing coolant to the upper coolant jacket is positioned on an upper surface of the exhaust port cooling jacket and coplanar with an upper surface of the upper coolant jacket. In any or all of the preceding examples, additionally or optionally, the upper coolant jacket further includes a first projection extending down and outwards from a top surface of the central piece towards a top surface of the lower coolant jacket on the one side of the central axis, the first projection further extending into a return coolant passage, parallel to the central axis, coupling the upper coolant jacket to the return feed gallery. In any or all of the preceding examples, additionally or optionally, the upper coolant jacket further includes a second projection extending outwards from the top surface of the central piece towards a top surface of the exhaust cooling port cooling jacket on the other side of the central axis, opposite the one side, the second projection abutting and receiving coolant from an outlet of the exhaust cooling port. In any or all of the preceding examples, additionally or optionally, the first projection extends in a direction opposite to the second projection, each of the first and second projections extending along a projection axis that is perpendicular to the central axis. In any or all of the preceding examples, additionally or optionally, the coolant system is selectively coupled to only the cylinder of engine. In any or all of the preceding examples, additionally or optionally, the cylinder liner jacket includes an outer cylindrical surface, an inner cylindrical surface, and a space defined between the inner and outer surface for circulating coolant, each of the inner and outer surface surrounding the cylinder. In any or all of the preceding examples, the system further comprising, additionally or optionally, a rod-shaped drilling coupling the second projection of the upper coolant jacket to the exhaust port cooling jacket on the one side of the central axis, the drilling substantially coaxial to the central axis and abutting the exhaust port cooling jacket.

Another example coolant system for an engine comprises: a coolant feed gallery coupled inside an engine crankcase, a coolant return gallery coupled inside the engine crankcase, a first cooling unit including a cylinder liner jacket surrounding a first cylinder, an upper coolant jacket and a lower coolant jacket surrounding a head of the first cylinder, and an exhaust port cooling jacket coupled to an exhaust port of the first cylinder, and a second cooling unit including another cylinder liner jacket surrounding a second cylinder, another upper coolant jacket and another lower coolant jacket surrounding the head of the second cylinder, and another exhaust port cooling jacket coupled to an exhaust port of the second cylinder, wherein each of the first and the second cooling unit is coupled to the coolant feed gallery and the coolant return gallery. In any preceding example, the system further comprising, additionally or optionally, a pump coupled to the coolant feed gallery for pumping coolant from the coolant feed gallery into each of the first cooling unit and the second cooling unit, and a proportioning valve coupled downstream of the pump for varying a ratio for coolant flow directed to the first cooling unit relative to the second cooling unit. In any or all of the preceding examples, additionally or optionally, each of the first cooling unit and the second cooling unit further includes a first feed passage flowing coolant from the coolant feed gallery to a corresponding cylinder liner jacket, and a second feed passage flowing coolant from the coolant feed gallery to a corresponding lower coolant jacket, the first feed passage positioned perpendicular to the second feed passage, the first feed passage and second feed passage further positioned on diametrically opposite ends of the first or second cooling unit. In any or all of the preceding examples, additionally or optionally, each of the first cooling unit and the second cooling unit further includes a third feed passage flowing coolant from the corresponding lower coolant jacket to a corresponding exhaust port cooling jacket, and a fourth feed passage flowing coolant from the corresponding lower coolant jacket to the corresponding upper coolant jacket, the third feed passage positioned parallel to the fourth feed passage. In any or all of the preceding examples, the system further comprising, additionally or optionally, a common coolant return passage receiving coolant from the exhaust port cooling jacket of each of the first and second cooling unit, the common coolant return passage returning coolant to the coolant return gallery. In any or all of the preceding examples, additionally or optionally, a central axis of the first cooling unit is coaxial with a central axis of the first cylinder and a central axis of the second cooling unit is coaxial with a central axis of the second cylinder, the first cylinder and the second cylinder positioned adjacent to one another along an engine block.

In yet another example, a method for cooling an engine comprises: flowing coolant, drawn from a feed gallery coupled to a crankcase, through a first cooling unit encasing a first cylinder block and an associated cylinder head, concurrently flowing coolant, drawn from the feed gallery coupled to the crankcase, through a second cooling unit encasing a second cylinder block and an associated cylinder head, wherein the first and second cylinder block are positioned adjacent to each other, each of the first and second cylinder block coupled to the crankcase, and varying a first ratio of coolant flowing through the first cooling unit relative to the second cooling unit based on individual cylinder operating conditions. In any preceding example, additionally or optionally, flowing coolant through the first cooling unit includes: flowing the coolant, drawn from the feed gallery, concurrently to each of a liner coolant jacket and a cylinder head lower coolant jacket of the first cylinder block, flowing coolant from the liner coolant jacket to the cylinder head lower coolant jacket, flowing coolant, drawn from the cylinder head lower coolant jacket, concurrently to each of a cylinder head upper coolant jacket and a cylinder head exhaust port coolant jacket, flowing coolant from the cylinder head exhaust port coolant jacket to the cylinder head upper coolant jacket, and returning coolant drawn from the cylinder head upper coolant jacket to a return gallery positioned below the feed gallery in the crankcase. In any or all of the preceding examples, the method further comprising, additionally or optionally, varying a second ratio of coolant flowing to the liner coolant jacket relative to the cylinder head lower coolant jacket of the first cooling unit based on cylinder head temperature, and varying a third ratio of coolant flowing to the cylinder head upper coolant jacket relative to the exhaust port cooling jacket of the first cooling unit based on exhaust temperature. In any or all of the preceding examples, additionally or optionally, varying the first ratio includes increasing the first ratio of coolant flowing through the first cooling unit relative to the second cooling unit, via a proportioning valve, as a cylinder head temperature of the first cylinder block exceeds the cylinder head temperature of the second cylinder block.

In an embodiment, an engine system includes a crankcase, a feed gallery coupled to the crankcase, a first cooling unit encasing a first cylinder block and an associated cylinder head, a second cooling unit encasing a second cylinder block and an associated cylinder head, and a controller. The first and second cylinder blocks are positioned adjacent to each other, and are coupled to the crankcase. The first cooling unit is configured to receive a first coolant flow from the feed gallery. The second cooling unit is configured to receive a second coolant flow from the feed gallery concurrent with the first coolant flow. The controller is configured to vary a ratio of the first coolant flow relative to the second coolant flow based on individual cylinder operating conditions.

This written description uses examples to disclose the invention, and to enable one of ordinary skill in the relevant art to practice embodiments of the invention, including making and using the devices or systems and performing the methods. The patentable scope of the invention is defined by the claims, and may include other examples that occur to one of ordinary skill in the relevant art. Such other examples are intended to be within the scope of the claims if they have structural elements that do not differ from the literal language of the claims, or if they include equivalent structural elements with insubstantial differences from the language of the claims.

The invention claimed is:

1. A coolant system for a cylinder of an engine, comprising:

a cylinder liner jacket encircling the cylinder and configured to circulate coolant around a liner of the cylinder, a central axis of the liner jacket coaxial with a central axis of the encircled cylinder;

a coolant feed gallery positioned within a crankcase below the cylinder;

a coolant return gallery positioned within the crankcase, below the coolant feed gallery;

a cylinder head lower coolant jacket surrounding a lower surface of a cylinder head positioned over the cylinder, the lower coolant jacket positioned above and coaxial with the liner jacket, a first inlet passage of the lower coolant jacket extending from the cylinder liner jacket, and a second inlet passage of the lower coolant jacket extending from the coolant feed gallery; and a cylinder head upper coolant jacket surrounding an upper surface of the cylinder head, the upper coolant jacket positioned above the lower coolant jacket, the upper coolant jacket including a central piece that is coaxial with the liner jacket, a first inlet passage of the upper coolant jacket extending from the lower coolant jacket, and a second inlet passage of the upper coolant jacket extending from a cylinder head exhaust port cooling jacket;

the cylinder head exhaust port cooling jacket coupled between the upper coolant jacket and the lower coolant jacket, and offset to one side of the central axis, wherein the lower coolant jacket is fluidically coupled to each of the coolant feed gallery, the upper coolant jacket, the cylinder liner jacket, and the exhaust port cooling jacket, an inlet passage of the cylinder head exhaust port cooling jacket extending from the lower coolant jacket.

2. The system of claim 1, wherein the lower coolant jacket being fluidically coupled to each of the coolant feed gallery, the upper coolant jacket, and the exhaust port cooling jacket includes the lower coolant jacket configured to receive coolant flow concurrently from each inlet passage of the lower coolant jacket, and the upper coolant jacket configured to receive coolant flow concurrently from each inlet passage of the upper coolant jacket.

3. The system of claim 2, wherein the lower coolant jacket is configured to receive coolant from the cylinder liner jacket at the first inlet passage via a first coolant passage positioned on the one side of the central axis and wherein the lower coolant jacket is configured to receive coolant from the coolant feed gallery at the second inlet passage positioned diametrically opposite the first inlet passage, and via a second coolant passage positioned on another side of the central axis, opposite the one side.

4. The system of claim 3, wherein the inlet passage of the exhaust port cooling jacket for receiving coolant from the lower coolant jacket is positioned on a lower surface of the exhaust port cooling jacket, the lower surface coplanar with the lower coolant jacket, and wherein an outlet of the exhaust port cooling jacket for directing coolant to the upper coolant jacket is positioned on an upper surface of the exhaust port cooling jacket and coplanar with an upper surface of the upper coolant jacket.

5. The system of claim 3, wherein the upper coolant jacket further includes a first projection extending down and outwards from a top surface of the central piece towards a top surface of the lower coolant jacket on the one side of the central axis, the first projection further extending into a return coolant passage, parallel to the central axis, coupling the upper coolant jacket to the return feed gallery.

6. The system of claim 5, wherein the upper coolant jacket further includes a second projection extending outwards from the top surface of the central piece towards a top surface of the exhaust cooling port cooling jacket on the other side of the central axis, opposite the one side, the second projection abutting and receiving coolant from an outlet of the exhaust cooling port.

7. The system of claim 6, wherein the first projection extends in a direction opposite to the second projection, each of the first and second projections extending along a projection axis that is perpendicular to the central axis.

8. The system of claim 1, wherein the coolant system is selectively coupled to only the cylinder of engine.

9. The system of claim 1, wherein the cylinder liner jacket includes an outer cylindrical surface, an inner cylindrical surface, and a space defined between the inner and outer surface for circulating coolant, each of the inner and outer surface surrounding the cylinder.

10. The system of claim 1, further comprising a rod-shaped drilling coupling the second projection of the upper coolant jacket to the exhaust port cooling jacket on the one side of the central axis, the drilling substantially coaxial to the central axis and abutting the exhaust port cooling jacket.

11. A coolant system for an engine, comprising:

a coolant feed gallery coupled inside an engine crankcase;

a coolant return gallery coupled inside the engine crankcase;

a first cooling unit including a cylinder liner jacket surrounding a first cylinder, an upper coolant jacket and a lower coolant jacket surrounding a head of the first cylinder, and an exhaust port cooling jacket coupled to an exhaust port of the first cylinder;

a second cooling unit including another cylinder liner jacket surrounding a second cylinder, another upper coolant jacket and another lower coolant jacket surrounding a head of the second cylinder, and another exhaust port cooling jacket coupled to an exhaust port of the second cylinder, wherein each of the first and the second cooling unit is coupled to the coolant feed gallery and the coolant return gallery;

a pump coupled to the coolant feed gallery for pumping coolant from the coolant feed gallery into each of the first cooling unit and the second cooling unit; and one or more proportioning valves coupled downstream of the pump and upstream of each of a first coolant feed line for the first cooling unit and a second coolant feed line upstream of the second cooling unit, the one or more proportioning valves having at least a first position and second position wherein changing positions of the one or more proportioning valves varies a ratio for coolant flow directed to the first coolant feed line relative to the coolant feed line.

12. The system of claim 11, wherein each of the first cooling unit and the second cooling unit further includes a first feed passage configured to flow coolant from the coolant feed gallery to a corresponding cylinder liner jacket, and a second feed passage configured to flow coolant from the coolant feed gallery to a corresponding lower coolant jacket, the first feed passage positioned perpendicular to the second feed passage, the first feed passage and second feed passage further positioned on diametrically opposite ends of the first or second cooling unit.

13. The system of claim 12, wherein each of the first cooling unit and the second cooling unit further includes a third feed passage configured to flow coolant from the corresponding lower coolant jacket to a corresponding exhaust port cooling jacket, and a fourth feed passage configured to flow coolant from the corresponding lower coolant jacket to the corresponding upper coolant jacket, the third feed passage positioned parallel to the fourth feed passage.

14. The system of claim 11, further comprising a common coolant return passage configured to receive coolant from the exhaust port cooling jacket of each of the first and second cooling unit, the common coolant return passage further configured to return coolant to the coolant return gallery.

15. The system of claim 11, wherein a central axis of the first cooling unit is coaxial with a central axis of the first cylinder and a central axis of the second cooling unit is coaxial with a central axis of the second cylinder, the first cylinder and the second cylinder positioned adjacent to one another along an engine block.

16. A method for cooling an engine, comprising:

flowing coolant, drawn from a feed gallery coupled to a crankcase, through a first cooling unit encasing a first cylinder block and an associated cylinder head;

concurrently flowing coolant, drawn from the feed gallery coupled to the crankcase, through a second cooling unit encasing a second cylinder block and an associated cylinder head, wherein the first and second cylinder blocks are positioned adjacent to each other, the first and second cylinder blocks coupled to the crankcase;

varying a first ratio of coolant flowing through the first cooling unit relative to the second cooling unit based on individual cylinder operating conditions; and varying the first ratio includes increasing the first ratio of coolant flowing through the first cooling unit relative to the second cooling unit, via a proportioning valve, as a cylinder head temperature of the first cylinder block exceeds the cylinder head temperature of the second cylinder block.

17. The method of claim 16, wherein flowing coolant through the first cooling unit includes:

flowing the coolant, drawn from the feed gallery, concurrently to each of a liner coolant jacket and a cylinder head lower coolant jacket of the first cylinder block;

flowing coolant from the liner coolant jacket to the cylinder head lower coolant jacket;

flowing coolant, drawn from the cylinder head lower coolant jacket, concurrently to each of a cylinder head upper coolant jacket and a cylinder head exhaust port coolant jacket;

flowing coolant from the cylinder head exhaust port coolant jacket to the cylinder head upper coolant jacket; and returning coolant drawn from the cylinder head upper coolant jacket to a return gallery positioned below the feed gallery in the crankcase.

18. The method of claim 17, further comprising:

varying a second ratio of coolant flowing to the liner coolant jacket relative to the cylinder head lower coolant jacket of the first cooling unit based on cylinder head temperature; and varying a third ratio of coolant flowing to the cylinder head upper coolant jacket relative to the exhaust port cooling jacket of the first cooling unit based on exhaust temperature.

19. The system of claim 1, further comprising an inlet passage of the cylinder liner jacket extending from the coolant feed gallery.

* * * * *